US008037936B2

(12) United States Patent
Neuroth et al.

(10) Patent No.: US 8,037,936 B2
(45) Date of Patent: Oct. 18, 2011

(54) METHOD OF HEATING SUB SEA ESP PUMPING SYSTEM

(75) Inventors: David H. Neuroth, Claremore, OK (US); Peter F. Lawson, Tulsa, OK (US); Jim F. Evenson, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 103 days.

(21) Appl. No.: 12/355,490

(22) Filed: Jan. 16, 2009

(65) Prior Publication Data

US 2009/0178803 A1 Jul. 16, 2009

Related U.S. Application Data

(60) Provisional application No. 61/021,538, filed on Jan. 16, 2008.

(51) Int. Cl.
*E21B 36/04* (2006.01)

(52) U.S. Cl. ..... 166/302; 166/62

(58) Field of Classification Search ..... 310/52–66; 417/366, 367, 423.8; 166/302, 57, 59, 60–62, 166/105

See application file for complete search history.

(56) References Cited

U.S. PATENT DOCUMENTS

| | | | | |
|---|---|---|---|---|
| 2,074,702 | A * | 3/1937 | MacClatchie | 417/364 |
| 2,556,435 | A * | 6/1951 | Moehrl et al. | 417/367 |
| 2,735,026 | A * | 2/1956 | Moerk | 310/54 |
| 4,401,159 | A * | 8/1983 | Kofahl | 166/59 |
| 4,685,867 | A * | 8/1987 | Patun et al. | 417/367 |
| 5,250,863 | A * | 10/1993 | Brandt | 310/54 |
| 6,006,837 | A * | 12/1999 | Breit | 166/302 |
| 6,167,965 | B1 * | 1/2001 | Bearden et al. | 166/250.15 |
| 6,260,615 | B1 | 7/2001 | Dalrymple et al. | |
| 6,318,467 | B1 * | 11/2001 | Liu et al. | 166/302 |
| 6,564,874 | B2 | 5/2003 | Narvaez | |
| 6,776,227 | B2 | 8/2004 | Beida et al. | |
| 6,939,082 | B1 | 9/2005 | Baugh | |
| 6,955,221 | B2 | 10/2005 | Bursaux | |
| 7,032,658 | B2 | 4/2006 | Chitwood et al. | |
| 7,037,105 | B2 | 5/2006 | Hayes | |
| 2002/0153141 | A1 * | 10/2002 | Hartman et al. | 166/302 |
| 2008/0272932 | A1 * | 11/2008 | Booker et al. | 340/854.9 |
| 2010/0143160 | A1 * | 6/2010 | Forsberg | 417/53 |

FOREIGN PATENT DOCUMENTS

EP 990800 A1 * 4/2000

* cited by examiner

*Primary Examiner* — Shane Bomar
*Assistant Examiner* — Blake Michener
(74) *Attorney, Agent, or Firm* — Bracewell & Giuliani LLP

(57) ABSTRACT

A system and method is provided for heating fluid to be pumped by an electrical submersible pumping system. Heat for heating the fluid may be inductively generated by adjusting the power delivered to the motor of the pumping system. In one example, the power adjustment includes supplying the voltage applied to the pump motor to a value less than voltage applied during normal operations. While lowering the voltage the electrical frequency may be varied as well as the electrical waveform.

14 Claims, 2 Drawing Sheets

METHOD OF HEATING SUB SEA ESP PUMPING SYSTEM

RELATED APPLICATIONS

This application claims priority to and the benefit of U.S. Provisional Application Ser. No. 61/021,538, filed Jan. 16, 2008, the full disclosure of which is hereby incorporated by reference herein.

BACKGROUND

1. Field of Invention

The present disclosure relates to an electrical submersible pumping system configured to heat fluid to be pumped by the system.

2. Description of Prior Art

Submersible pumping systems are often used in hydrocarbon producing wells for pumping fluids from within the well bore to the surface. These fluids are generally liquids and include produced liquid hydrocarbon as well as water. One type of system used in this application employs an electrical submersible pump (ESP). Submersible pumping systems, such as electrical submersible pumps (ESP) are often used in hydrocarbon producing wells for pumping fluids from within the well bore to the surface. ESP systems may also be used in subsea applications for transferring fluids, for example, in horizontal conduits or vertical caissons arranged along the sea floor. When ESP pumps are deployed in seabed applications they reside in a cold sea water environment with temperatures in the mid 30° F. to 40° F. range. However, when the ESP pump is energized and it is required to handle production fluids at considerably higher temperatures, sometimes in excess of 300° F.

One unique problem associated with these large temperature excursions is difficulty in starting up the system after a shutdown. Crude oil that is easily pumped at production temperatures is often very viscous when it is cooled to sea water temperature, thereby effectively locking the pump stages of the ESP so the pump is unable to be rotated. One way to restart the system is to heat the crude oil in the pump to sufficiently reduce the oil viscosity into a range where the resistance to flow is reduced such that the pump can be restarted. A similar temperature related issue is associated with hydrates which accumulate in the pump when production fluids are cooled, also locking the pump impellers. Like viscous crude, this can be resolved by heating the hydrates and freeing the pump to rotate. In other situations, depending on the fluid characteristics of the oil being pumped, there may be some advantages associated with reducing the fluid viscosity by heating the pump and motor before fully starting the system to reduce the fluid viscosity.

SUMMARY OF INVENTION

Disclosed herein is a method of handling fluid in a borehole, the method may include providing an ESP system in the borehole. The ESP system may include a pump, a pump motor, and an electrical power supply in communication with the pump motor. The method further includes inductively heating the pump motor to generate heat energy, heating fluid in the borehole with heat generated by the pump motor, and pumping the heated fluid with the pump. The heat energy generated can be transferred to fluid adjacent the motor or to the pump. Transferring the generated heat energy from the pump motor can be accomplished using working fluid sealed in a heat transfer system. The method can further involve sensing motor and/or fluid temperature. The method can further include adjusting inductively heating the motor based on sensing the motor and/or fluid temperature. Voltage provided to the pump motor can be supplied at a value lower than voltage supplied during normal operation, this can be performed while providing power to the pump motor at a frequency higher than during normal operation. The method can further include providing power to the pump motor in a waveform that varies from the waveform provided during normal pump operation.

An electrical submersible pumping system is also described herein. In an embodiment the pumping system includes a pump having a fluid inlet, a pump motor coupled to the pump, and a heat transfer system in heat energy communication with the pump motor and fluid to be pumped by the pump. Heat generated by the pump motor can be transferred for heating the fluid to be pumped and reducing its resistance to flow. The heat transfer system can include a lower liquid portion proximate the motor in heat energy communication with the pump motor, an upper/vaporization portion in heat energy communication with the fluid to be pumped, tubes extending between the lower liquid portion and the upper/vaporization portion, and a working fluid that circulates through the lower liquid portion, the tubes, and the upper/vaporization portion. The lower liquid portion may have a first and second reservoir and tubes extending between the reservoirs. The upper/vaporization portion can include a first and second reservoir and tubes extending between the reservoirs. The upper/vaporization portion may be disposed adjacent the pump so that heat energy transferred from the upper/vaporization portion to the pump can heat fluid in the pump. The upper/vaporization portion is optionally disposed so that heat energy transferred from the upper/vaporization portion flows to fluid outside of the pump. The system may include a variable speed controller in electrical communication with the pump motor, so that manipulating the variable speed controller adjusts the electrical power delivered to the pump motor for inductively generating heat energy. A temperature sensor in communication with the variable speed controller can also be included with the system.

BRIEF DESCRIPTION OF DRAWINGS

Some of the features and benefits of the present invention having been stated, others will become apparent as the description proceeds when taken in conjunction with the accompanying drawings, in which.

The following

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Enclosed herein is a method of handling fluid in a caisson or other borehole using an ESP system. In one embodiment, enhanced caisson or borehole fluid flow through an ESP system is described herein that includes inductively heating the pump motor of an ESP system. The heat energy generated can be transferred, either actively or passively, to heat the fluid pumped. The heat can be transferred directly to the pump or the fluid before it reaches the pump. The pump motor may be inductively heated by altering the power supplied to the ESP motor. Such altering may include altering voltage, altering the frequency, altering the waveform of electrical power delivered to the pump motor, or combinations thereof.

In one example of use, altering includes changing the electrical supply to the pump motor from that of a normal or expected operating scenario or a normal or expected operating range. For the purposes of discussion herein, electrical supply includes power, current, voltage, frequency, and waveform. Reducing voltage supplied to a pump motor while altering the supplied electrical frequency and/or supplied waveform from a normal/expected operating value or range of values can inductively generate heat in the pump motor stator stack. Optionally, a variable speed drive may be employed to perform the altering. It is well within the capabilities of those skilled in the art to alter the electrical supply so that heat energy may be generated using an ESP system. When supplying electricity as described above, the corresponding rotor may not rotate if the pump is locked by the presence of the viscous fluid or it may turn at slow speeds wherein the motor efficiency is very low thereby generating heat.

Figure 1:
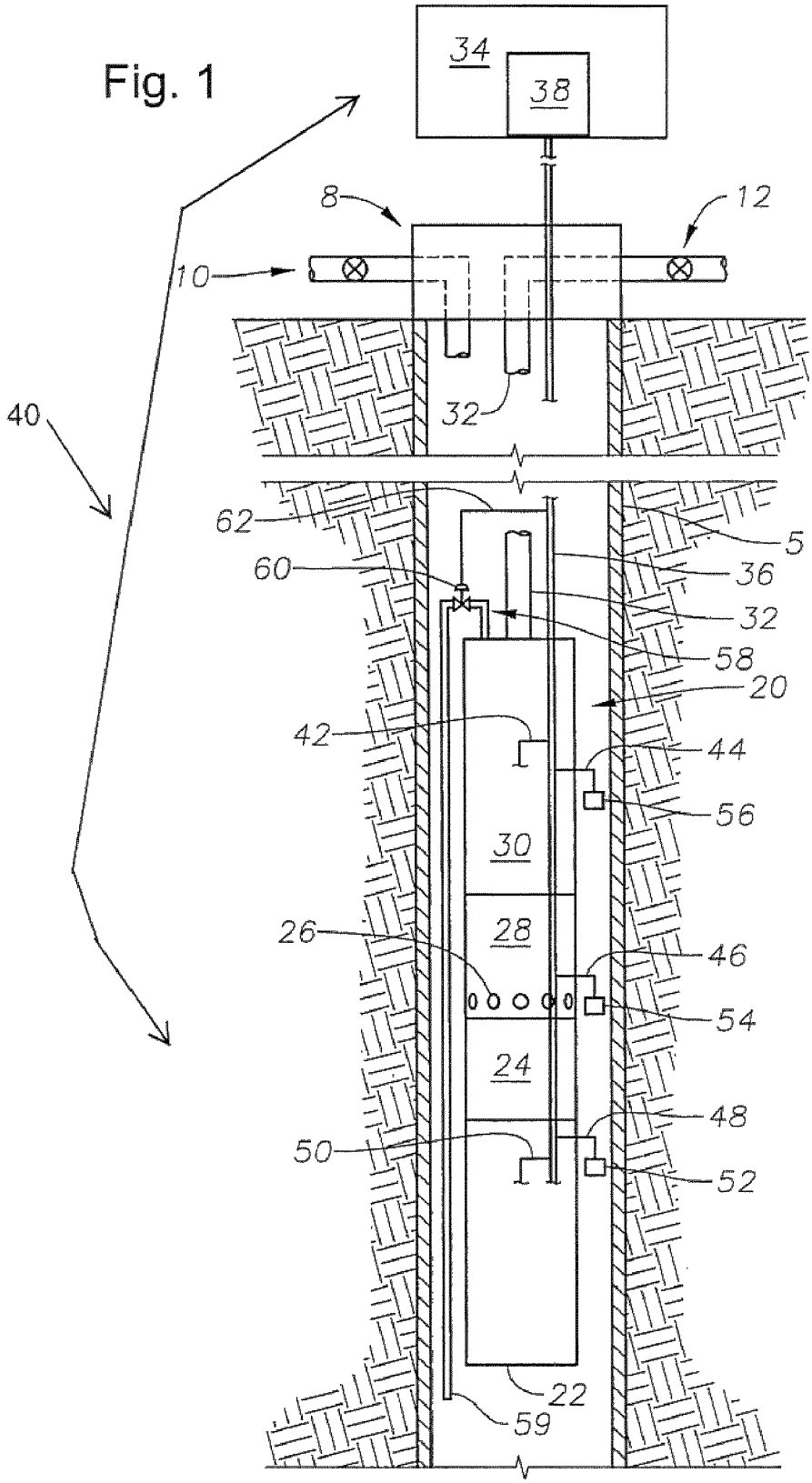
FIG. 1 is a side schematical view of one example of an ESP disposed in a sea floor caisson having an associated heating system.

With reference now to FIG. 1, one embodiment of an ESP system having a heating means is shown in a side schematical view. In this embodiment, an ESP system 20 is disposed in a vertical caisson 5 bored through the seafloor. A wellhead 8 is provided on the caisson 5 having a flow inlet 10 and flow outlet 12. However the caisson 5 may also be a horizontal or sloped flow line (such as a jumper line or horizontal pump cartridge) extending along the sea bed. The system 20 comprises an ESP motor 22 (or pump motor), a seal/equalizer section 24, an optional separator section 28 having inlet ports 26 on its outer housing, and a pump 30 on the system 20 upper end. As is known, an ESP system 20 receives fluid to the inlets 26 where it is directed to the pump impellers (not shown) for delivery to surface via production tubing 32.

A variable speed drive 34, which may be disposed on a platform above sea level; is in communication with the ESP motor 22 for controlling ESP motor 22 operations. The variable speed drive 34 may also be used to alter the supply voltage and frequency to the ESP motor 22. The variable speed drive 34 is shown in communication with the ESP motor 22 via line 36. As noted above, the variable speed drive 34 can adjust the operating parameters of the ESP motor 22 causing it to generate heat by regulating its voltage, adjusting the power frequency, adjusting the supplied power waveform, or combinations of these. These adjustments can cause the ESP motor 22 to generate more heat energy than under typical operation. The heat energy produced by the ESP motor 22 can be in addition to or in lieu of rotational energy that is typically delivered to the pump 30. The heat energy generated by the ESP motor 22 can be used for heating the pump 30, heating fluid in the pump 30, or heating fluid to be pumped by the pump 30. The fluid to be pumped by the pump 30 may be in a space proximate the inlets 26, or optionally further down the system 20 within the caisson 5. The ESP motor 22 may or may not rotate when inductively generating heat.

Transferring the heat generated by the ESP motor 22 to the fluid entering the pump 30 can be accomplished in one of the manners described below. For example, fluid may be heated by the ESP motor 22 as it passes the ESP motor 22 after flowing into the caisson 5. The heated fluid with lowered viscosity experiences less flow resistance when traveling to the pump 30 and through the inlets 26, thereby enhancing pumping flow. Optionally, fluid may be redirected from the pump 30 discharge to upstream of the pump motor 22. Similar to the fluid flowing into the caisson 5, recirculated fluid absorbs thermal energy from the ESP motor 22 and carries it to the inlets 26 and pump 30.

A recirculation line 58 is schematically illustrated communicating with the pump 30 discharge with an exit 59 below the ESP motor 22. A valve 60 on the recirculation line 58 can regulate flow therethrough. The valve 60 is shown communicated with the variable speed drive 34 via line 62 and line 36, and may be controlled by the variable speed drive 34 or controlled independently. Similarly, if desired, oil heated in this manner can be redirected to other locations to heat such things as valves, pipes, subsea trees etc before being returned to the exit 59.

Temperature sensors may be employed to monitor ESP motor 22 temperature and fluids adjacent the ESP motor 22. For example, when the ESP motor 22 reaches a designated temperature, the power supply to the ESP motor 22 may be manipulated, such as by the variable speed control 34 to slowly rotate the pump shaft thus drawing heated fluid from adjacent the ESP motor 22 to the pump intake 26. Examples of such adjustments include changes to voltage, changes to frequency, or changes in waveform. The particular temperature profiles desired over a particular time period may dictate if adjusting power supply based on temperature readings are performed intermittently or on a continuous circulation basis. A control algorithm may be employed for controlling the ESP motor 22; the algorithm may be stored within the variable speed control 34 or in a separate controller 38 housed within the variable speed control 34. Optionally, the algorithm may be outside of the variable speed control 34. In this alternative embodiment algorithm results may be communicated via communication link 40 to the variable speed control 34 and used for operating the ESP motor 22.

As shown in FIG. 1, temperature probes 52, 54, 56 are disposed in the caisson 5 and configured for monitoring fluid temperature within the caisson 5 and adjacent the ESP system 20. The temperature probes 52, 54, 56 are in communication with the line 36 via respective lines 48, 46, 44. Accordingly, discreet temperature measurements may be taken at fluid points within the caisson 5 communicated to the variable speed control 34. Additional or alternative temperature measurements may as well be recorded at other locations where temperature readings may be relevant or of interest. Optionally, the ESP motor 22 temperature may be obtained by the lines 36, 50 directly connected to the ESP motor 22. A similar line 42 provides temperature communication between the line 36 and the pump 30. The line 36, which can provide three-phase power to the ESP motor 22, can also have data signals superimposed thereon for transmission to the variable speed control 34. The data signals can emanate from the temperature sensors in the fluid, sensors on the equipment, or the valve 60. The variable speed drive 34 may be utilized so that steps programmed therein can be undertaken so that the ESP motor 22 operations can be adjusted based on real time readings of temperature.

Optionally, when the ESP system 20 is not in use, the variable speed control 34, or other surface control scheme, may monitor fluid temperature and/or motor temperature for determining if an appropriate pumping temperature exists. The variable speed control 34 may be further configured to energize the ESP motor 22 for heating the ESP system 20 to maintain proper pumping temperature in the system 20. In this example of use, the pump 30 and pumping system 20 is continuously heating even in situations when the ESP system 20 is not otherwise operating.

Figure 2:
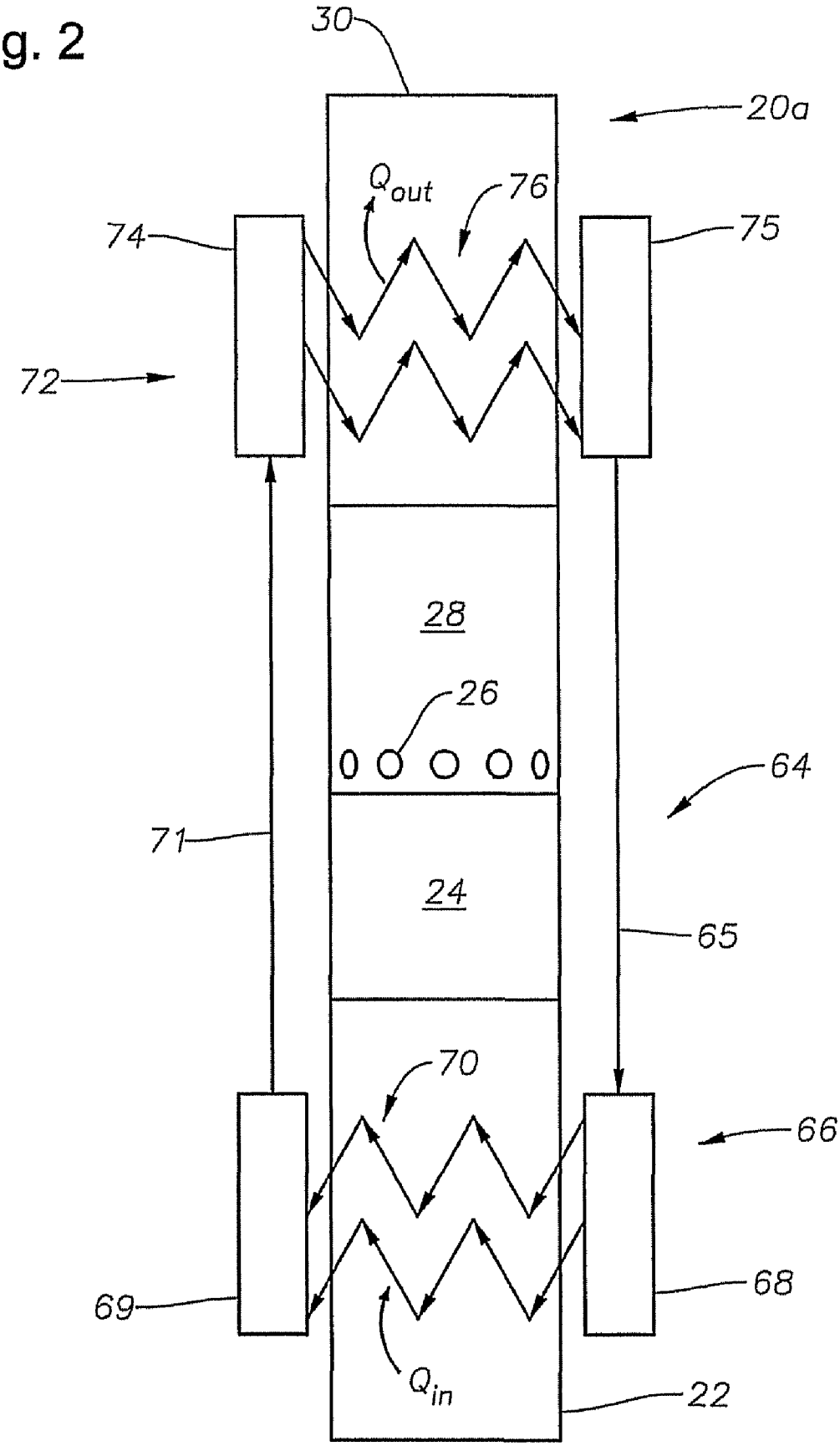
FIG. 2 is a side schematical view of a heat transfer system for transferring heat between a pump motor and a pump.

With reference to FIG. 2, a schematical view is shown illustrating a heat transfer system 64 for transferring heat from the ESP motor 22 to the pump 30. The heat transfer system 64 as shown comprises a lower/liquid portion 66 arranged proximate to the ESP motor 22. The lower/liquid portion 66 comprises a first and second reservoir 68, 69 disposed at different locations along the surface of the ESP motor 22. Tubes 70 are illustrated extending between the reservoirs (68, 69). In this schematical representation, the heat transfer system 64 is a sealed system with vaporizing and condensing fluid circulating within the sealed system.

Heat energy from the ESP motor 22 is graphically represented as by the arrow and $Q_{in}$ shown entering the tube 70. In this stage of the process, the heat $Q_{in}$ entering the tube 70 vaporizes the working fluid therein as it is entering into the exit reservoir 69. The heated vaporized fluid then flows from the reservoir 69 through the flow line 71 to an upper/vaporization portion 72. The upper/vaporization portion 72 also includes corresponding reservoirs 74, 75 with tubes 76 extending therebetween. In this step of the cycle, the vaporized fluid flows through the tubes 76 transferring heat to the pump 30 and condenses the working fluid within the tubes 76. $Q_{out}$ and its associated arrow represent the heat transferred from the fluid in the tubes 76 to the pump 30. The condensed fluid flows from the tubes 76 into the collection reservoir 75 and is directed through flow line 65 to reservoir 68.

It should be pointed out that the manner of transferring heat from the ESP motor 22 to the pump 30, or to other components of the system such as valves, trees, or pipes etc, is not limited to the schematic example provided in FIG. 2. Instead embodiments exist that include any type of sealed system circulating a working heat transfer fluid between the pump 22 and ESP motor 30 (or other components to be heated). The scope of the present disclosure includes the use of any type of heat tube as well as any thermo-siphon system is one option possible for application with the system and apparatus herein described. Additionally, means for generating heat is not limited to the inductive manner of heating the ESP motor 22 described, but can includes other modes of heating the pump motor, such as by resistance heating of the motor windings.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

The invention claimed is:

1. A method of pumping well fluid, comprising:

providing an electrical submersible pump (ESP) system, the ESP system having a pump and a pump motor coupled to the pump by a seal/equalizer section that reduces a pressure differential between lubricant in the motor and fluid in the borehole, the pump motor having power selectively delivered at a normal operating voltage, a normal waveform, and a normal frequency, and an electrical power supply in communication with the pump motor;

providing the ESP with a heat transfer system including a lower portion proximate the pump motor, an upper portion proximate the pump, tubes extending alongside the seal/equalizer section between the upper and lower portions, and a working fluid within the lower portion, the upper portion and the tubes;

immersing the ESP in the well fluid;

supplying a voltage to the pump motor from the electrical power supply that is less than the normal operating voltage to inductively generate heat energy with the pump motor; and transferring heat energy generated by the pump motor to the working fluid in the lower portion of the heat transfer system, causing the working fluid to vaporize and flow to the upper portion via one of the tubes, thereby transferring heat to the pump and surrounding well fluid and causing the working fluid in the upper portion to condense and return to the lower portion via the other of the tubes.

2. The method claim 1, wherein transferring the heat energy causes the working fluid to continuously flow in a flow path between the lower and the upper portions.

3. The method of claim 1, further comprising adjusting the step of inductively heating the motor based on sensing the motor and/or well fluid temperature.

4. The method of claim 1, wherein immersing the ESP in the well fluid comprises suspending the ESP in a subsea conduit, and flowing the well fluid from a subsea well into the subsea conduit.

5. The method of claim 1, further comprising providing power to the pump motor in a waveform that varies from the waveform provided during normal pump operation.

6. The method of claim 1 further comprising providing power to the pump motor in a frequency different than provided during normal operation.

7. An electrical submersible pumping system for pumping well fluid from a well, comprising:

a pump having a fluid inlet;

a pump motor coupled to the pump and having a normal operating voltage, so that when the pump motor is operated at a voltage less than the normal operating voltage, heat is generated by the pump motor;

a seal/equalizer section mounted between the pump and the pump motor for reducing a pressure differential between well fluid on an exterior of the motor and lubricant within the motor;and a heat transfer system having a lower portion in heat energy communication with the pump motor, an upper portion in heat energy communication with the pump, transfer tubes extending exterior of the pump, seal/equalizer section and motor alongside the seal/equalizer section from the lower portion to the upper portion and a vaporizable working fluid contained in the lower portion, the upper portion and the transfer tubes, so that heat generated by the pump motor can be transferred to the working fluid and from the working fluid to the pump for reducing resistance of the well fluid to flow.

8. The system of claim 7, wherein the lower portion of the heat transfer system comprises at least one lower reservoir proximate the motor in heat energy communication with the pump motor, and the upper portion comprises at least one upper reservoir in heat energy communication with the well fluid to be pumped.

9. The system of claim 7, wherein the lower portion of the heat transfer system comprises first and second lower reservoirs and communication tubes extending between the lower reservoirs.

10. The system of claim 9, wherein the upper portion of the heat transfer system comprises first and second upper reservoirs and communication tubes extending between the upper reservoirs.

11. The system of claim 1, wherein the lower reservoirs, upper reservoirs, transfer tubes and communication tubes are arranged so that the working fluid vaporizes while in the first lower reservoir, condenses while in the upper reservoirs and returns as a liquid to the second lower reservoir.

12. The system of claim 7, further comprising a variable speed controller in electrical communication with the pump motor, so that manipulating the variable speed controller adjusts the electrical power delivered to the pump motor for inductively generating heat energy.

13. The system of claim 7, further comprising a motor temperature sensor in communication with the variable speed controller.

14. The system of claim 7, further comprising a controller for regulating the voltage supplied to the pump motor and for reducing the voltage to a level below the normal operating level and inductively generating heat with the pump motor.

* * * * *